US005875962A

United States Patent [19]

Jørgensen-Beck et al.

[11] Patent Number: 5,875,962

[45] Date of Patent: Mar. 2, 1999

[54] DISPENSER CARTON BOX

[75] Inventors: Frode Jørgensen-Beck; Heinrich Wilhelm Lambach, both of Horsens, Denmark

[73] Assignee: Schur Engineering A/S, Horsens, Denmark

[21] Appl. No.: 860,605

[22] PCT Filed: Jan. 4, 1996

[86] PCT No.: PCT/DK96/00002

§ 371 Date: Jul. 7, 1997

§ 102(e) Date: Jul. 7, 1997

[87] PCT Pub. No.: WO96/20873

PCT Pub. Date: Jul. 11, 1996

[30] Foreign Application Priority Data

Jan. 5, 1995 [DK] Denmark ..... 0006/95

[51] Int. Cl.[6] ..... B65D 17/00

[52] U.S. Cl. ..... 229/220

[58] Field of Search ..... 229/220; 220/351

[56] References Cited

U.S. PATENT DOCUMENTS

| | | | |
|---|---|---|---|
| 2,939,621 | 6/1960 | Mittleman | 229/220 X |
| 3,040,953 | 6/1962 | Tindall | 229/220 |
| 4,066,207 | 1/1978 | Jorgensen-Beck et al. | 229/220 |
| 5,139,195 | 8/1992 | McClure | 229/143 |

*Primary Examiner*—Gary E. Elkins
*Assistant Examiner*—Tri M. Mai
*Attorney, Agent, or Firm*—Sixbey, Friedman, Leedom & Ferguson; David S. Safran

[57] ABSTRACT

In carton boxes of that particular dispenser type, where the broad front side (2) of the box exhibits a dispenser opening, which is internally covered by a slide panel (18) with an opening (20), the slide panel is displaceable into a dispensing position by an outward pivoting of an associated end flap (26) of the box. The slide panel is prevented from falling into the box in that it has laterally projecting side flaps (28) which ride on the top edges of inner, upright side wall portions (8) of the box, this riding engagement being secured by the side flaps being folded down along the upper, exterior area of the side wall portions (8). Outer side wall portions (12) folded own from the front or top panel (2) are at their lower edge area welded or glued to the root zone of the inner, upright side wall portions. The associated folding of the said side flaps (28) may result in an inward pivoting of the inner side wall portions (8), which in turn disables a perfect face-to-face engagement in the lower joining zone (A, B) between the side wall portions. According to the invention this drawback is eliminated in arranging for a longitudinal cutting line (C) near the middle of the inner side wall portion (8), such that by the folding down of the side flap (28) it will only be the strip area above this line which is forced inwardly, while the remaining lowermost strip area can be joined safely face to face with the outer side wall portion (12).

3 Claims, 1 Drawing Sheet

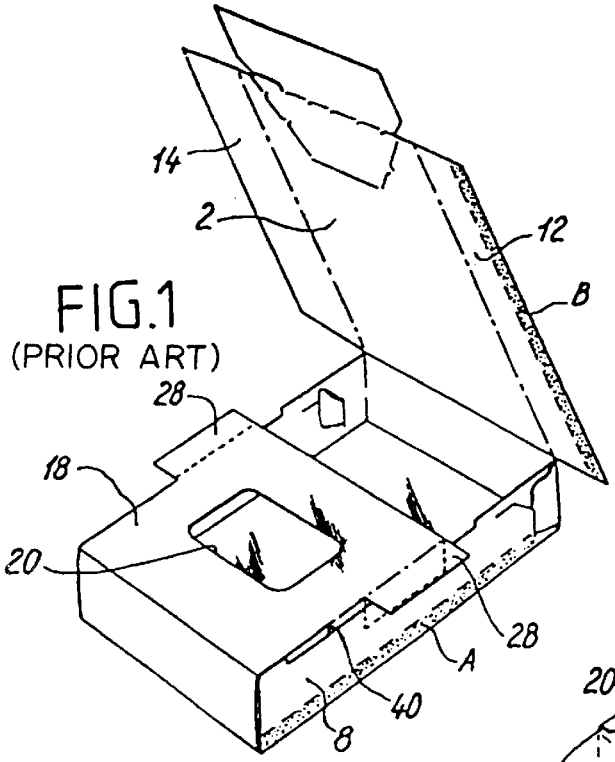
FIG.1
(PRIOR ART)
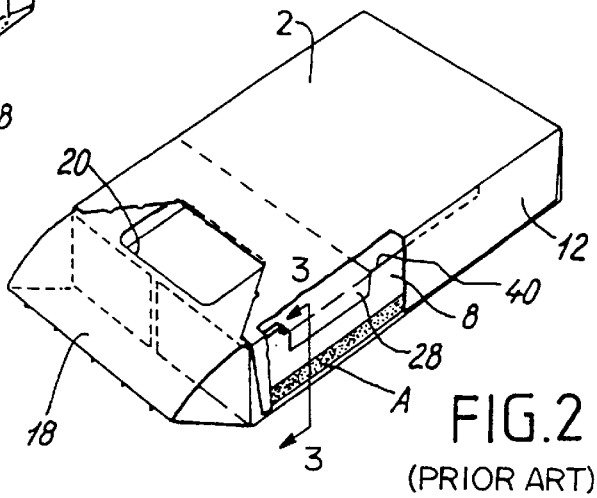
FIG.2
(PRIOR ART)
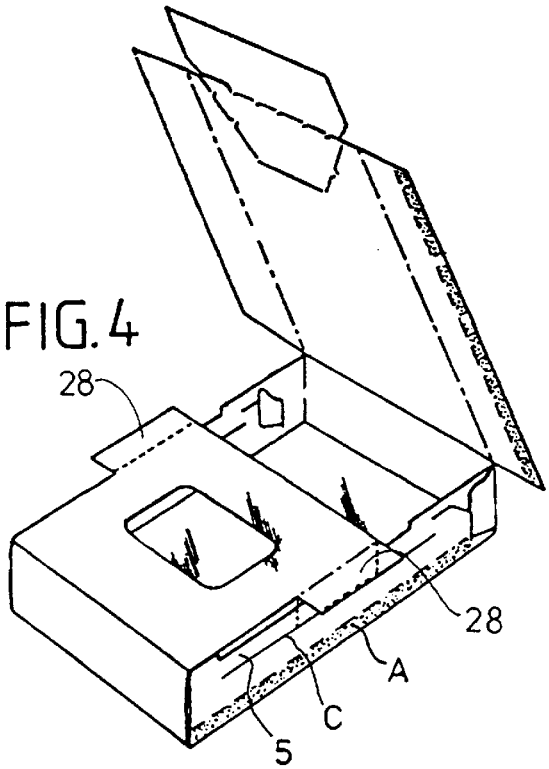
FIG.4
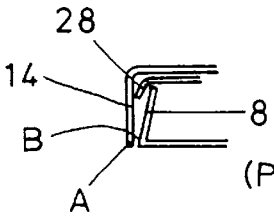
FIG.3
(PRIOR ART)
FIG.5
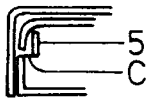

DISPENSER CARTON BOX

BACKGROUND OF THE INVENTION

FIELD OF THE INVENTION

The present invention relates to a carton box of such a type which is shown in FIGS. 3 and 7 of U.S. Pat. No. A 4,066,207, reproduced as FIGS. 1 and 2 in the present drawing. An important element of this box type is an interior front panel 18 which is displaceable for exposing a dispenser opening 20 and is supported against falling into the box in having projecting side flaps 28, which are folded down over the respective top edges 40 of upright, inner narrow-side portions 8 of the box, while an exterior front panel 2 has corresponding narrow-side portions 14, which are folded down at the outside of the said portions 8 as upstanding from the rear box panel and are secured to these portions along a root area A thereof, such that the box sides can be fully closed at the lower or rear box panel while at the top or front there will be an interior, free slot, in which the folded down side flap 28 of the displaceable front panel 18 may be freely displaced for an effective opening and closing of the box.

By an automatic erection of these boxes it is, in principle, relatively easy to establish the particular engagement between the said parts, viz. in causing the relatively shortly protruding side flaps 28 on the inner, displaceable front panel 18 to be automatically folded down over the top edges 40 of the upstanding side portions 8 as a consequence of the overlying narrow-side portions 14 of the outer front panel 2 being correspondingly folded down for being secured to the said lower root area A of the upstanding side portions 8 of the rear panel.

After this folding down the side flaps 28, in being only shortly protruding, will show a marked tendency to fold back due to the resiliency of the carton material, whereby they will outwardly affect the middle area of the exterior, folded down narrow-side portions 12 and 14 of the outer front panel 2. This implies complications with respect to the lower fixing of these side portions to the root areas A of the upright side portions 8 of the rear panel, because it is disadvantageous that the relevant lower plate areas A,B are thereby exposed to separating forces immediately after the folding down, by which the fixing engagement is to be established.

Moreover, after their folding down, the short side flaps will act as spacer members between the upper areas of the respective inner and outer side portions, thereby making a desired face-to-face engagement of the lower areas of the side portions difficult.

On this background it is necessary to arrange for a complicated mechanical fixation of the pressed together surface areas A and B until, during the current production, a stabilized binding between the surfaces has been achieved. Alternatively, it is possible to use a particularly strong binder, but also this will imply increased production costs.

SUMMARY OF THE INVENTION

With the present invention it has been found that the said problem can be solved in a much easier manner, viz. in preparing the inner, upstanding narrow-side portions 8 of the rear panel with a longitudinal slot extending mainly in parallel with the top edges of these portions somewhat spaced there beneath, such that the top edge areas are left as strip portions fixed at their ends only. By the folding down of the outer side portions the short projecting side flaps will still be co-folded, but now with the possibility of locally forcing the said strip portions slightly inwardly, such that the folding down in this local area will automatically take place slightly further inwardly and without the side flaps causing the upper edge of the remaining, lower part of the inner side portion to be pressed inwardly.

Thereby the situation will be greatly changed, partly because the folding area of the short side flap will is displaced inwardly, whereby the said outwardly directed resilient pressure on the outer narrow-side portion will be correspondingly reduced, and partly because the said spacer member will no longer be active. Thence, the exterior side portion is much easier to bring into a real face-to-face engagement with the lower part of the interior side portion, such that an effective joining between these portions is greatly facilitated.

BRIEF DESCRIPTION OF THE DRAWINGS

In the following the invention is described in more detail with reference to the drawing, in which:

FIGS. 1–2 are the figures already explained;

FIG. 3 is a sectional view of the box shown in FIG. 2 taken along lines 3—3 therein;

FIG. 4 is a view corresponding to FIG. 1, of a box modified according to the invention; and FIG. 5 is a sectional view of the modified box of FIG. 4 in a view thereof, corresponding to FIG. 3.

DETAILED DESCRIPTION OF THE PREFERRED EMBODIMENT

FIGS. 1 and 2 have already been discussed, and FIG. 3 shows the mutual location of the inner side portion 8, the side flap 28 and the outer side portion 14 as according to FIG. 2. It is shown—slightly exaggerated that the parts assume such positions that it is not easy to arrange for a full surface contact between the area portions A and B underneath the lower edge of the folded down side flap 28, both because the latter presses the side portion 8 inwardly and also, due to its resiliency, seeks to force the side portion 14 outwardly.

According to the present invention, as shown in FIG. 4, there is provided a slot or cutting line C along and slightly below the top edge portion 40 of the side portion 8, whereby the relevant upper area of the side portion 8 appears as a strip portion 5 which will be inwardly depressable between its opposite ends.

This is shown in more detail in FIG. 5, which clearly shows that it is now possible for the side portion 14 to be folded down for a pure face-to-face engagement with the lower part of the inner side portion 8, such that a good face bonding is easily achievable. Besides, the outwardly directed resilient pressure from the folded down side flaps will be reduced as a consequence of the side flaps being somewhat retracted and folded more softly than in FIG. 3.

What is claimed is:

1. A carton box of the type having an opening in a broad side portion and with an underlying slide panel that is slidable along a sliding path for closing and opening of said opening, at least one side of said slide panel having a side flap for holding the slide panel [being kept] in position, said side flap slidably engaging a top edge portion of an upstanding, interior lateral side portion which is covered by an exterior side wall portion folded down from said broad side portion and fixed along its lower edge area to a root area of the interior lateral side portion, and said side flap extending beyond said top edge portion and being folded down thereover so as to be slidably housed in an upper part of a space between said side portions;

wherein the interior lateral side portion is provided with a longitudinal slot therein, said longitudinal slot creating an upper, inwardly depressable strip area of the interior lateral side portion above the slot and along the sliding path of the side flap.

2. A box according to claim 1, wherein said longitudinal slot is located slightly below a lower end of the side flap and an underlying part of the interior side portion is glued or welded flat against the exterior side portion.

3. A box according to claim 2, in which the side flap co-operates with a depressed top edge portion having an upright front limit edge forming aprojection stop for the slide panel and the longitudinal slot extends forwardly to an area of said front limit edge.

* * * * *